US005758315A

United States Patent [19]

Mori

[11] Patent Number: 5,758,315

[45] Date of Patent: May 26, 1998

[54] ENCODING/DECODING METHOD AND APPARATUS USING BIT ALLOCATION AS A FUNCTION OF SCALE FACTOR

[75] Inventor: Masahito Mori, Kanagawa, Japan

[73] Assignee: Sony Corporation, Tokyo, Japan

[21] Appl. No.: 583,080

[22] PCT Filed: May 23, 1995

[86] PCT No.: PCT/JP95/00989

§ 371 Date: Jan. 22, 1996

§ 102(e) Date: Jan. 22, 1996

[87] PCT Pub. No.: WO95/32499

PCT Pub. Date: Nov. 30, 1995

[30] Foreign Application Priority Data

May 25, 1994 [JP] Japan ..... 6-111257
May 25, 1994 [JP] Japan ..... 6-111262

[51] Int. Cl.[6] ..... G10L 9/00

[52] U.S. Cl. ..... 704/229; 704/230

[58] Field of Search ..... 395/2.38, 2.39, 395/2.91–2.95; 704/229, 230, 500–504

[56] References Cited

U.S. PATENT DOCUMENTS

| | | | |
|---|---|---|---|
| 4,142,071 | 2/1979 | Croisier et al. | 395/2.38 |
| 4,912,763 | 3/1990 | Galand et al. | 395/2.39 |
| 5,175,719 | 12/1992 | Iimura | 369/58 |
| 5,216,660 | 6/1993 | Iimura | 369/116 |
| 5,490,130 | 2/1996 | Akagiri | 395/2.39 |
| 5,495,552 | 2/1996 | Sugiyama et al. | 395/2.35 |
| 5,581,653 | 12/1996 | Todd | 395/2.39 |
| 5,583,962 | 12/1996 | Davis et al. | 395/2.39 |
| 5,590,108 | 12/1996 | Mitsuno et al. | 395/2.38 |

FOREIGN PATENT DOCUMENTS

| | | |
|---|---|---|
| 54-54506 | 4/1979 | Japan . |
| 60-27459 | 6/1985 | Japan . |
| 63-117527 | 5/1988 | Japan . |
| 4-129430 | 4/1992 | Japan . |
| 4-199200 | 7/1992 | Japan . |

*Primary Examiner*—Kee M. Tung
*Attorney, Agent, or Firm*—Frommer Lawrence & Haug LLP; William S. Frommer

[57] ABSTRACT

At an encoder 1, an input signal delivered to an input terminal 100 is divided into 32 subband signals by an analysis filter bank 101 to determine scale factors indicating magnification which normalizes respective subband signals by a scaling section 102 to determine the numbers of allocation bits of the respective subband signals by a bit allocation section 103 in dependency upon their scale factors to quantize the respective subband signals by the determined numbers of allocation bits by a quantizing section 104 to encode the respective quantized subband signals and the scale factors with respect to the respective subband signals. On the other hand, at a decoder 2, an inverse quantizing section 108 is used to determine the numbers of allocation bits by using scale factors included in the encoded signal with respect to the respective subband signals of the encoded signal to inverse-quantize the subband signals to judge whether or not scale factors are preserved with respect to the respective inverse-quantized subband signals to carry out, for a second time, inverse quantization with respect to the subband signals where no scale factor is preserved so as to preserve scale factors.

24 Claims, 7 Drawing Sheets

ENCODING/DECODING METHOD AND APPARATUS USING BIT ALLOCATION AS A FUNCTION OF SCALE FACTOR

TECHNICAL FIELD

This invention relates to an encoding method, a decoding method, an encoding/decoding method, an encoding apparatus, a decoding apparatus, and an encoding/decoding apparatus suitable when used for dividing an original signal such as audio data, etc. into signals (signal components) in a plurality of frequency bands to carry out encoding/decoding thereof, and more particularly relates to an encoding method, a decoding method, an encoding/decoding method, an encoding apparatus, a decoding apparatus, and an encoding/decoding apparatus such that, in quantizing subband signals obtained after undergone frequency band division, or spectrum signals obtained by orthogonal transform processing, etc., the numbers of bits are dynamically allocated to respective subbands or respective spectrum groups.

BACKGROUND ART

For example, as the technique for encoding audio data, there is so called Sub-Band Coding (SBC) for dividing audio data into data portions in a plurality of frequency bands to encode them.

In accordance with the Sub-Band Coding system, in the case where the numbers of bits for quantizing sub-band signals obtained after undergone frequency band division by the Band Pass Filter (BPF) are allocated, there is conducted a processing to calculate energies of respective sub-bands by using the sub-band signals to allocate the numbers of bits thereto in dependency upon their energies.

Alternatively, apart from the sub-band signals, there is carried out a processing to determine spectrum components (spectrum signals) by the Fast Fourier Transform (FFT), etc. to allocate the numbers of bits by making use of the auditory sense characteristic from those spectrum components (spectrum signals).

Moreover, in the so-called Transform Coding for bundling spectrum components (spectrum signals) obtained after undergone the orthogonal transform processing, etc. by several components so that they are divided into groups to carry out quantization every respective spectrum groups, in the case where the numbers of bits are allocated to respective spectrum groups, a processing for allocating the numbers of bits in dependency upon energies of respective spectrum groups, and a processing for allocating the numbers of bits by making use of the auditory sense characteristic from the spectrum are carried out.

In a manner as described above, the numbers of bits are allocated to respective sub-bands or respective spectrum groups, and sub-band signals or spectrum signals are normalized by scale factors in dependency upon the allocated numbers of bits. Quantization processing is implemented to the signals thus normalized. Then, the sub-band signals or the spectrum signals which have undergone quantization processing are composed into a bit stream for transmission or recording onto the recording medium in accordance with a predetermined format. The bit stream thus composed is outputted.

In this case, in decoding data which has undergone encoding processing in a manner as described above, bit allocation information which is the numbers of bits allocated to the sub-bands or the spectrum groups cannot be determined by inverse operation from the encoded data. For this reason, a format adapted for recording, at the same time, bit allocation information along with scale factors is used.

Further, e.g., in the memory for composition into the bit stream, in composition into the bit stream in accordance with the format determined as described above, there is limitation in capacity for storing the bit allocation information into the memory. For this reason, after upper limit is set with respect to the number of allocation bits, bit allocation to the sub-bands or the spectrum groups is carried out.

For example, in the Precision Adaptive Subband Coding (PASC) system employed in the so-called Digital Compact Cassette (DCC), in allocating the numbers of bits to respective bands obtained after undergone frequency band division, Fourier Transform is used to calculate spectrum components. Then, those spectrum components are used to calculate masking pattern to calculate the numbers of allocation bits. In this PASC system, the format adapted for recording bit allocation information and scale factors is employed, and the upper limit of the number of allocation bits is set to 15 bits.

Moreover, in the so-called Mini Disc (MD), the system of compressing audio data so that data quantity is reduced to one fifth (hereinafter referred to as ⅕ compression) is employed. In this system, there is no standardization in regard to bit allocation. In the ⅕ compression system, there is employed the format adapted for recording bit allocation information and scale factors of coding unit in which spectrum components (spectrum signals) are bundled every several components, and the upper limit of the number of allocation bits is set to 16 bits.

Further, T.A. Ramstad has proposed, in "CONSIDERATIONS ON QUANTIZATION AND DYNAMIC BIT-ALLOCATION IN SUBBAND CODERS", ICASSP '86 pp. 841–844, a method of calculating energies every respective subbands to allocate bits while repeatedly dividing those energies by constant.

In addition, in regard to quantization of the dynamic range of respective sub-bands or respective spectrum groups, there are many instances where the signal amplitude is small as the property of signal. On the other hand, in the case where the signal amplitude is large as the property of the auditory sense, even when quantizing noise is great, quantizing noise is difficult to be heard by masking. For this reason, quantization using logarithmic function is carried out.

As the Sub-Band Coding system, various systems have been conventionally proposed. As the representative system, there is, e.g., 32 band/subband coding in the Audio data coding algorithm ISO/IEC IS 11172-3 (MPEG1 audio) of the International Standard, i.e., layer I of the so-called MPEG audio.

The coding algorithm of the layer 1 of the MPEG audio will now be described.

Initially, an input signal linearly quantized so that one sample is equal to 16 bits is divided into sub-band signals of 32 sub-bands by the subband analysis filter in the state where 384 samples are caused to be one frame and respective sub-bands are caused to be 12 samples.

Then, scale factors indicating magnification for normalizing dynamic ranges of respective sub-band signals into 1 are determined every 12 samples as described below.

Namely, the maximum value of the absolute value of 12 samples, i.e., dynamic range is determined to use, as scale factor, minimum values larger than that dynamic range.

| index | SF(scale factor) |
|---|---|
| | Table 1A |
| 0 | 2.00000000000000 |
| 1 | 1.58740105196820 |
| 2 | 1.25992104989487 |
| 3 | 1.00000000000000 |
| 4 | 0.79370052598410 |
| 5 | 0.62996052494744 |
| 6 | 0.50000000000000 |
| 7 | 0.39685026299205 |
| 8 | 0.31498026247372 |
| 9 | 0.25000000000000 |
| 10 | 0.19842513149602 |
| 11 | 0.15749013123686 |
| 12 | 0.12500000000000 |
| 13 | 0.09921256574801 |
| 14 | 0.07874506561843 |
| 15 | 0.06250000000000 |
| 16 | 0.04960628287401 |
| 17 | 0.03937253280921 |
| 18 | 0.03125000000000 |
| 19 | 0.02480314143700 |
| 20 | 0.01968626640461 |
| | Table 1B |
| 21 | 0.01562500000000 |
| 22 | 0.01240157071850 |
| 23 | 0.00984313320230 |
| 24 | 0.00781250000000 |
| 25 | 0.00620078535925 |
| 26 | 0.00492156660115 |
| 27 | 0.00390625000000 |
| 28 | 0.00310039267963 |
| 29 | 0.00246078330058 |
| 30 | 0.00195312500000 |
| 31 | 0.00155019633981 |
| 32 | 0.00123039165029 |
| 33 | 0.00097656250000 |
| 34 | 0.00077509816991 |
| 35 | 0.00061519582514 |
| 36 | 0.00048828125000 |
| 37 | 0.00038754908495 |
| 38 | 0.00030759791257 |
| 39 | 0.00024414062500 |
| 40 | 0.00019377454248 |
| | Table 1C |
| 41 | 0.00015379895629 |
| 42 | 0.00012207031250 |
| 43 | 0.00009688727124 |
| 44 | 0.00007689947814 |
| 45 | 0.00006103515625 |
| 46 | 0.00004844363562 |
| 47 | 0.00003844973907 |
| 48 | 0.00003051757813 |
| 49 | 0.00002422181781 |
| 50 | 0.00001922486954 |
| 51 | 0.00001525878906 |
| 52 | 0.00001211090890 |
| 53 | 0.00000961243477 |
| 54 | 0.00000762939453 |
| 55 | 0.00000605545445 |
| 56 | 0.00000480621738 |
| 57 | 0.00000381469727 |
| 58 | 0.00000302772723 |
| 59 | 0.00000240310869 |
| 60 | 0.00000190734863 |
| 61 | 0.00000151386361 |
| 62 | 0.00000120155435 |

On the other hand, result obtained by allowing the input signal to undergo Fast Fourier Transform (FFT) is used to calculate masking, thus to determine the numbers of allocation bits with respect to respective sub-bands. Then, respective sub-band signals are quantized in accordance with the obtained numbers of allocation bits. Namely, quantized value Y can be determined by the operation expressed as the formula (1) by using scale factor SF, the number of allocation bits N, and sub-band signal X:

$$Y=rint\{(X/SF)\times((2^N-1)/2)\} \quad (1)$$

In the above formula, "rint {z}" indicates function representing integer nearest to "Z".

The decoding algorithm of the layer I of the MPEG audio will now be described.

When the sub-band signal X is derived from the above-mentioned formula (1), this sub-band signal X is expressed as follows:

$$X=Y\times SF\times(2/(2^N-1)) \quad (2)$$

The respective encoded sub-band signals are inverse-quantized in accordance with the above-mentioned formula (2). Namely, an approach is employed to inverse-quantize quantized values Y so that they are equal to values which are just middle of respective partitions to multiply them by scale factors SF to carry out inverse scaling. Then, the respective inverse-quantized sub-band signals are synthesized into an audio signal by sub-band synthesis filter.

Further, the audio data encoding/decoding method or the audio data encoding/decoding apparatus for carrying out encoding processing and decoding processing as described above is used, e.g., in copying audio data.

However, in the case where audio data is copied, i.e., encoding is carried out with respect to a decoded signal for a second time in the above-mentioned audio data encoding/decoding method, when bit allocation is carried out by using the result of the Fast Fourier Transform as described above, the number of allocated (allocation) bits at the time of the last encoding and the number of allocated (allocation) bits of this time are not necessarily in correspondence with each other. Further, since any quantization error takes place in quantization, if the number of allocated bits of the last time and the number of allocated bits of this time are different from each other, any further quantization error would take place also at this stage. For this reason, sound quality would be deteriorated every time encoding/decoding is repeated.

Moreover, in the case where the numbers of bits for quantization of sub-bands in the sub-band coding or spectrum groups in the transform coding are dynamically allocated, e.g., energies of respective sub-bands or respective spectrum groups calculated by using respective sub-band signals or spectrum signals were used, or information calculated independently of the sub-band signals or the spectrum signals were used to allocate the numbers of bits. For this reason, the circuit for bit allocation became very large.

Further, when data encoded by an encoding system as described above is decoded by a decoding apparatus, etc., the numbers of bits allocated to respective sub-bands or respective spectrum groups were required along with scale factors of the respective sub-bands or the respective spectrum groups. Accordingly, there took place the necessity of outputting allocation bit information along with the scale factors. For this reason, the number of allocation bits per one sub-band signal or one spectrum signal was reduced, thus failing to improve quantization efficiency.

In addition, since there was the upper limit in the number of allocation bits, in the case where a signal of a specific frequency is encoded, sufficient number of bits could not be allocated to the sub-band or the spectrum group where that frequency is included.

This invention has been made in view of actual circumstances of the prior arts as described above, and has the following objects.

An object of this invention is to provide an encoding method, a decoding method, an encoding/decoding method, an encoding apparatus, a decoding apparatus, and an encoding/decoding apparatus which can improve the sound quality.

Another object of this invention is to provide an encoding method, a decoding method, an encoding/decoding method, an encoding apparatus, a decoding apparatus, and an encoding/decoding apparatus which can simplify the circuit for bit allocation.

A further object of this invention is to provide an encoding method, a decoding method, an encoding/decoding method, an encoding apparatus, a decoding apparatus, and an encoding/decoding apparatus which can improve quantization efficiency.

A still further object of this invention is to provide an encoding method, a decoding method, an encoding/decoding method, an encoding apparatus, a decoding apparatus, and an encoding/decoding apparatus which can allocate sufficient numbers of bits to respective bands of signals (signal components) divided into a plurality of frequency bands.

DISCLOSURE OF THE INVENTION

In an encoding method according to this invention, an approach is employed to divide an original signal into signals (signal components) in a plurality of frequency bands to determine, with respect to the signals of the respective divided frequency bands, numbers of allocation bits as bit allocation condition where only their scale factors are caused to be dependent upon the original signal to carry out bit allocation to quantize the signals of the respective frequency bands by the numbers of allocation bits which have undergone bit allocation to encode only the quantized signals of the respective frequency bands and scale factors with respect to the signals of the respective frequency bands.

In the encoding method according to this invention, the numbers of allocation bits are determined, with respect to, e.g., sub-band signals obtained by dividing an original signal into signals (signal components) in sub-bands of a plurality of frequency bands, or spectrum signals obtained by dividing an original signal into spectrum groups of a plurality of frequency bands, as the bit allocation condition where only their scale factors are caused to be dependent upon the original signal.

Moreover, in the encoding method according to this invention, the above-mentioned scale factors SF are calculated by the operation expressed below by using quantized value SFid (integer) of the dynamic range, constant r, constant k, and integer constant s with respect to signals of the respective frequency bands:

$$SF=r^{SFid/s+k}$$

to determine the numbers of allocation bits in accordance with the calculated scale factors SF to carry out bit allocation.

Further, in the encoding method according to this invention, the number of allocation bits is determined without setting an upper limit of the number of allocation bits.

Moreover, a decoding method according to this invention is directed to a decoding method for decoding an encoded signal encoded by dividing an original signal into signals (signal components) in a plurality of frequency bands, determining, with respect to the signals of the respective divided frequency bands, numbers of allocation bits as the bit allocation condition where only their scale factors are caused to be dependent upon the original signal, quantizing signals of the respective frequency bands by the numbers of allocation bits which have undergone bit allocation, and encoding only the quantized signals of the respective bands and the scale factors with respect to the respective frequency bands, wherein the decoding method comprises the steps of: determining the numbers of allocation bits by using the scale factors included in the encoded signal with respect to the signals of the respective frequency bands of the encoded signal, inverse-quantizing the signals of the respective frequency bands of the encoded signal by using the determined numbers of allocation bits, determining whether or not the scale factors are preserved with respect to the inverse-quantized signals of the respective frequency bands, and carrying out, for a second time, inverse-quantization with respect to the signal of each of the frequency band where no scale factor is preserved so that the scale factor is preserved so as to decode the encoded signal in the state where the scale factors of the signals of the respective frequency bands are preserved.

In the decoding method according to this invention, e.g., sub-band signals obtained by dividing an original signal into signals in sub-bands of a plurality of frequency bands, or spectrum signals obtained by dividing an original signal into signals in spectrum groups of a plurality of frequency bands are decoded in the state where respective scale factors are preserved.

An encoding/decoding method according to this invention comprises: (an encoding step including) dividing an original signal into signals in a plurality of frequency bands, determining, with respect to the signals of the respective divided frequency bands, numbers of allocation bits as bit allocation condition where only their scale factors are caused to be dependent upon the original signal to carry out bit allocation, quantizing the signals of the respective frequency bands by the numbers of allocation bits which have undergone bit allocation, and encoding only the quantized signals of the respective frequency bands and the scale factors with respect to the respective frequency bands; (a decoding step including) determining the numbers of allocation bits by using the scale factors included in the encoded signal with respect to the signals of the respective frequency bands of the encoded signal, inverse-quantizing the signals of the respective frequency bands of the encoded signal by using the determined number of allocation bits, determining whether or not the scale factors are preserved with respect to the inverse-quantized signals of the respective frequency bands, and carrying out, for a second time, inverse-quantization with respect to the signal of each of the frequency bands where no scale factor is preserved so that the scale factor is preserved so as to decode the encoded signal in the state where the scale factors of the signals of the respective frequency bands are preserved.

In the encoding/decoding method according to this invention, e.g., sub-band signals obtained by dividing an original signal into signals in sub-bands of a plurality of frequency bands, or spectrum signals obtained by dividing an original signal into signals in spectrum groups of a plurality of frequency bands are encoded to decode the encoded signal in the state where the scale factors of the signals of the respective frequency bands are preserved.

Moreover, in the encoding/decoding method according to this invention, the scale factors SF are calculated by the operation expressed below by using quantized value SFid (integer) of the dynamic range, constant r, constant k and integer constant s with respect to the signals of the respective frequency bands $$SF=r^{SFid/s+k}$$

to determine the numbers of allocation bits in accordance with the calculated scale factors, thus to carry out bit allocation.

Further, in the encoding/decoding method according to this invention, the number of allocation bits is determined without setting an upper limit of the number of allocation bits.

Moreover, an encoding apparatus according to this invention comprises: band dividing means for dividing an original signal into signals in a plurality of frequency bands, scaling means for calculating scale factors with respect to the signals of the respective frequency bands divided by the band dividing means, bit allocation means for determining, with respect to the signals of the respective frequency bands divided by the band dividing means, numbers of allocation bits, as bit allocation condition where only scale factors calculated by the scaling means are caused to be dependent upon the original signal to carry out bit allocation, quantizing means for quantizing the signals of the respective frequency bands and the scale factors by the numbers of allocation bits which have undergone bit allocation by the bit allocation means, and formatting means for outputting, in a predetermined format, an encoded signal generated by encoding only the signals of the respective frequency bands and the scale factors with respect to the signals of the respective frequency bands which have been quantized by the quantizing means.

In the encoding apparatus according to this invention, the above-mentioned band dividing means is used to divide an original signal into e.g., subband signals of a plurality of frequency bands, or spectrum signals of spectrum groups.

Moreover, in the encoding apparatus according to this invention, the scaling means is used to calculate the scale factors SF by the operation expressed below by using quantized value SFid (integer) of the dynamic range, constant r, constant k and integer constant s with respect to the signals of the respective frequency bands:

$$SF=r^{SFid/s+k}$$

Further, in the encoding apparatus according to this invention, the bit allocation means is used to determine the number of allocation bits without setting the upper limit of the number of allocation bits.

Moreover, a decoding apparatus according to this invention is directed to a decoding apparatus for decoding an encoded signal generated by dividing an original signal into signals (signal components) in a plurality of frequency bands, determining, with respect to the signals of the respective divided frequency bands, numbers of allocation bits as the bit allocation condition where only their scale factors are caused to be dependent upon the original signal, quantizing signals of the respective frequency bands by the numbers of allocation bits which have undergone bit allocation, and encoding only the quantized signals of the respective frequency bands and the scale factors with respect to the signals of the respective frequency bands, the decoding apparatus comprises inverse quantizing means for determining the numbers of allocation bits by using the scale factors included in the encoded signal with respect to the signals of the respective frequency bands of the encoded signal, inverse-quantizing the signals of the respective frequency bands of the encoded signal by using the determined numbers of allocation bits, determining whether or not the scale factors are preserved with respect to the inverse-quantized signals of the respective frequency bands and carrying out, for a second time, inverse-quantization with respect to the signal of each of the frequency bands where no scale factor is preserved so as to preserve the scale factor.

An encoding/decoding apparatus according to this invention comprises: encoding means for dividing an original signal into signals (signal components) in a plurality of frequency bands, determining, with respect to the signals of the respective divided frequency bands, numbers of allocation bits as bit allocation condition where only their scale factors are caused to be dependent upon the original signal to carry out bit allocation, quantizing the signals of the respective frequency bands by the numbers of allocation bits which have undergone bit allocation and encoding only the quantized signals of the frequency bands and the scale factors with respect to the quantized signals of the respective frequency band; and decoding means for determining the numbers of allocation bits by using the scale factors included in the encoded signal, with respect to the signals of the respective frequency bands of the encoded signal, inverse-quantizing the signals of the respective frequency bands of the encoded signal by using the determined numbers of allocation bits, determining whether or not the scale factors are preserved with respect to the inverse-quantized signals of the respective frequency bands, and carrying out, for a second time, inverse quantization with respect to the signal of each of the frequency bands where no scale factors is preserved so as to decode the encoded signals of the respective frequency bands in the state where the scale factors are preserved.

In the encoding/decoding apparatus according to this invention, wherein the encoding means includes, e.g., band dividing means for dividing the original signal into the signals (signal components) in the plurality of frequency bands, scaling means for calculating the scale factors with respect to the signals of the respective frequency bands divided by the band dividing means, bit allocation means for determining the numbers of allocation bits as the bit allocation condition where only the scale factors calculated by the scaling means are caused to be dependent upon the original signal to carry out bit allocation with respect to the signals of the respective frequency bands divided by the band dividing means, quantizing means for quantizing the signals of the respective frequency bands and the scale factors by the numbers of allocation bits which have undergone bit allocation by the bit allocation means, and formatting means for outputting, in a predetermined format, an encoded signal generated by encoding only the signals of the respective frequency bands and the scale factors with respect to the signals of the respective frequency bands which have been quantized by the quantizing means.

In the encoding/decoding apparatus according to this invention, the band dividing means is used to divide an original signal into, e.g., sub-band signals of a plurality of frequency bands or spectrum signals of spectrum groups.

Further, in the encoding/decoding apparatus according to this invention, the scaling means is used to calculate the scale factors SF by the operation expressed below by using quantized value SFid (integer) of the dynamic range, constant r, constant k and integer constant s with respect to the signals of the respective frequency bands:

$$SF=r^{SFid/s+k}$$

In addition, in the encoding/decoding apparatus according to this invention, the bit allocation means is used to determine the number of allocation bits without setting an upper limit of the numbers of allocation bits.

BEST MOST FOR CARRYING OUT THE INVENTION

A preferred embodiment of this invention will now be described in detail with reference to the attached drawings.

Figure 1:
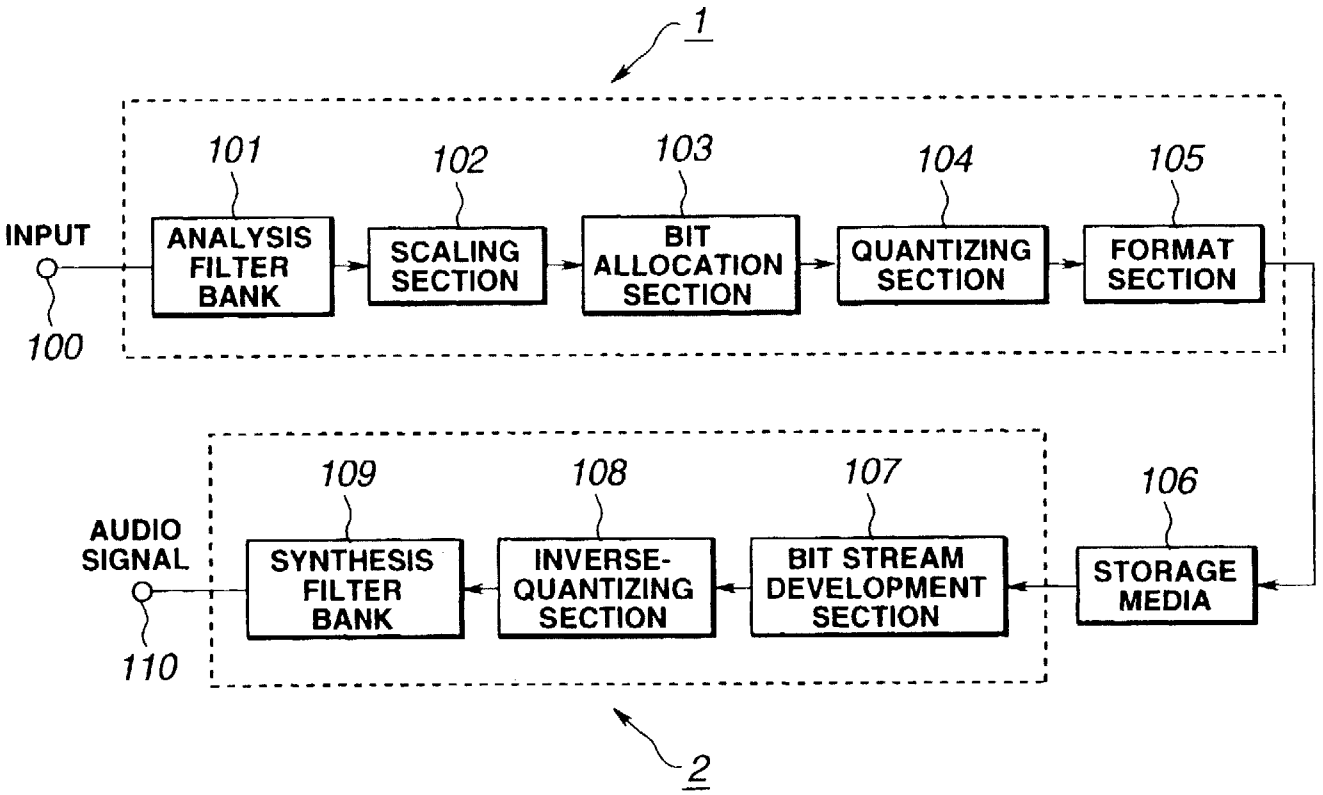
FIG. 1 is a block diagram showing the configuration of an encoding/decoding apparatus for an audio signal to which this invention is applied.

An encoding method, a decoding method and an encoding/decoding method according to this invention are carried out by an encoding/decoding apparatus for audio signal of a structure as shown in FIG. 1, for example.

The encoding/decoding apparatus for audio signal is constituted with an encoder 1 for encoding an audio signal inputted through an input terminal 100 as an original signal, storage media 106 onto which respective band signals encoded by the encoder 1 are recorded, and a decoder 2 for decoding the respective encoded band signals recorded on the storage media 106 to output generated audio signals through an output terminal 110.

Initially, the configuration and the operation of the encoder 1 will be described below.

The encoder 1 is composed of an analysis filter bank 101 for dividing an original signal inputted through the input terminal 100 into subband signals of 32 bands, a scaling section 102 for calculating scale factors with respect to the respective subband signals divided by the analysis filter bank 101, a bit allocation section 103 for determining the numbers of allocation bits with respect to respective subband signals in accordance with the scale factors calculated by the scaling section 102 to carry out bit allocation, a quantizing section 104 for quantizing the subband signals by the numbers of allocation bits allocated by the bit allocation section 103, and a formatting section for formatting the respective subband signals, bit allocation information and scale factors which have been quantized by the quantizing section 104 to record them onto the storage media 106.

The input terminal 100 is supplied, as an original signal, e.g., an audio signal having frequency band of 0~24 kHz. The audio signal is assumed such that one sample is linearly quantized into 16 bits, e.g., by sampling frequency fs of 48 kHz.

Figure 2:
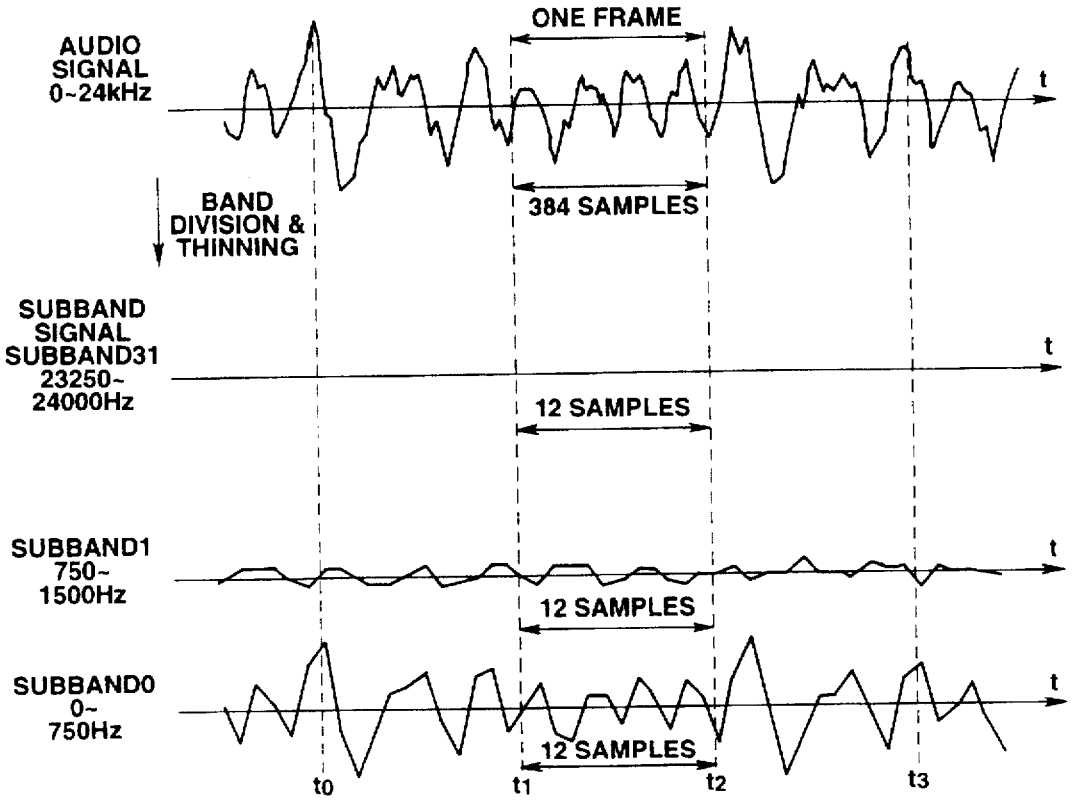
FIG. 2 is a view for explaining band division processing in analysis filter bank of the encoding/decoding apparatus.

The analysis filter bank 101 serves to divide the input signal into 32 subband signals. For example, as shown in FIG. 2, in the operation mode of the sampling frequency fs=48 kHz, an original signal having frequency band of 0~24 kHz is divided into 32 subband signals each having bandwidth of 750 Hz. In more practical sense, with respect to an audio signal linearly quantized so that one sample is equal to 16 bits, in the state where 384 samples is caused to be one frame and respective subbands are caused to be 12 samples, the audio signal is divided into 32 subbands subband 0~subband 31.

The scaling section 102 determines, in a manner described below, every 12 samples, scale factors indicating magnification which normalizes dynamic ranges of respective subband signals into 1 with respect to respective subband signals divided into 32 subbands.

Figure 3:
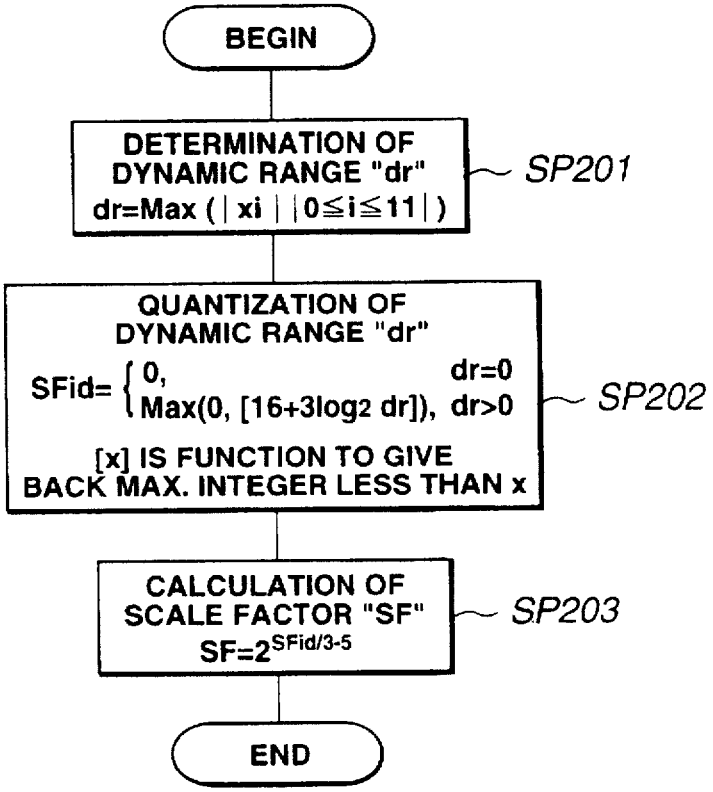
FIG. 3 is a flowchart showing calculation processing of scale factors in scaling section of the encoding/decoding apparatus.

The processing for calculating scale factors with respect to respective subband signals in the scaling section 102 will be described below with reference to the flowchart shown in FIG. 3.

Calculations of scale factors are carried out every respective subbands (12 samples), i.e., 384 times as a whole.

Initially, at step SP201, the maximum value of the absolute value of 12 samples, i.e., dynamic range dr is determined. The dynamic range dr is expressed as follows:

$$dr=Max\{|x_i||0\leqq i\leqq 11|\}$$

At the subsequent step SP202, the dynamic range dr is quantized. To speak in more practical sense, in the case where dr=0, i.e., the dynamic range dr is zero, quantized value SFid of the dynamic range dr is expressed as follows:

$$SFid=0$$

Moreover, in the case where dr≧0, i.e., the dynamic range dr is greater than zero, the quantized value SFid is expressed as follows:

$$SFid=Max\{0,[16+3log_2dr]\}$$

In the above expression, "[x]" indicates function to give back maximum integer less than "x".

At step SP203, scale factor SF is calculated by the operation expressed below by using constant r (=2), constant K (=−5) and integer constant s (=3) from the quantized value SFid:

$$SF=r^{SFid/s+k}=2^{SFid/3-5}$$

In a manner as described above, the scaling section 102 calculates scale factors SF of respective subbands.

At the scaling section 102, in place of calculating scale factors SF of respective subband signals in this way, an approach may be employed to determine maximum absolute values every 12 samples of the respective subband signals to use, as scale factor, values equal to the maximum absolute value, or minimum one of values greater than the maximum absolute value of the scale factors shown in Table 2.

| index | SF(scale factor) |
|---|---|
| | Table 2A |
| 0 | 0.031250000000000000 |
| 1 | 0.039372532809214780 |
| 2 | 0.049606282874006244 |
| 3 | 0.062500000000000000 |
| 4 | 0.078745065618429588 |
| 5 | 0.099212565748012460 |
| 6 | 0.125000000000000000 |
| 7 | 0.157490131236859180 |
| 8 | 0.198425131496024920 |
| 9 | 0.250000000000000000 |
| 10 | 0.314980262473718240 |
| 11 | 0.396850262992049840 |
| 12 | 0.500000000000000000 |
| 13 | 0.629960524947436480 |
| 14 | 0.793700525984099680 |
| 15 | 1.000000000000000000 |
| 16 | 1.259921049894873200 |

-continued

| index | SF(scale factor) |
|---|---|
| 17 | 1.587401051968199400 |
| 18 | 2.000000000000000000 |
| 19 | 2.519842099789745900 |
| 20 | 3.174802103936398700 |
| | Table 2B |
| 21 | 4.000000000000000000 |
| 22 | 5.039682199579493700 |
| 23 | 6.349604207872797400 |
| 24 | 8.000000000000000000 |
| 25 | 10.079368399158987000 |
| 26 | 12.699208415745595000 |
| 27 | 16.000000000000000000 |
| 28 | 20.158736798317967000 |
| 29 | 25.398416831491197000 |
| 30 | 32.000000000000000000 |
| 31 | 40.317473596635935000 |
| 32 | 50.796833662982394000 |
| 33 | 64.000000000000000000 |
| 34 | 80.634947193271870000 |
| 35 | 101.593667325964790000 |
| 36 | 128.000000000000000000 |
| 37 | 161.269894386543740000 |
| 38 | 203.187334651929580000 |
| 39 | 256.000000000000000000 |
| 40 | 322.539788773087650000 |
| | Table 2C |
| 41 | 406.374669303858920000 |
| 42 | 512.000000000000000000 |
| 43 | 645.079577546175300000 |
| 44 | 812.749338607717850000 |
| 45 | 1024.000000000000000000 |
| 46 | 1290.159155092350600000 |
| 47 | 1625.498677215435700000 |
| 48 | 2048.000000000000000000 |
| 49 | 2580.318310184701200000 |
| 50 | 3250.997365430871400000 |
| 51 | 4096.000000000000000000 |
| 52 | 5160.636620369402400000 |
| 53 | 6501.994708861742800000 |
| 54 | 8192.000000000000000000 |
| 55 | 10321.273240738805000000 |
| 56 | 13003.989417723486000000 |
| 57 | 16384.000000000000000000 |
| 58 | 20642.546481477610000000 |
| 59 | 26007.978835446971000000 |
| 60 | 32768.000000000000000000 |
| 61 | 41285.092962955219000000 |
| 62 | 52015.957670893942000000 |
| 63 | 65536.000000000000000000 |

Figure 4:
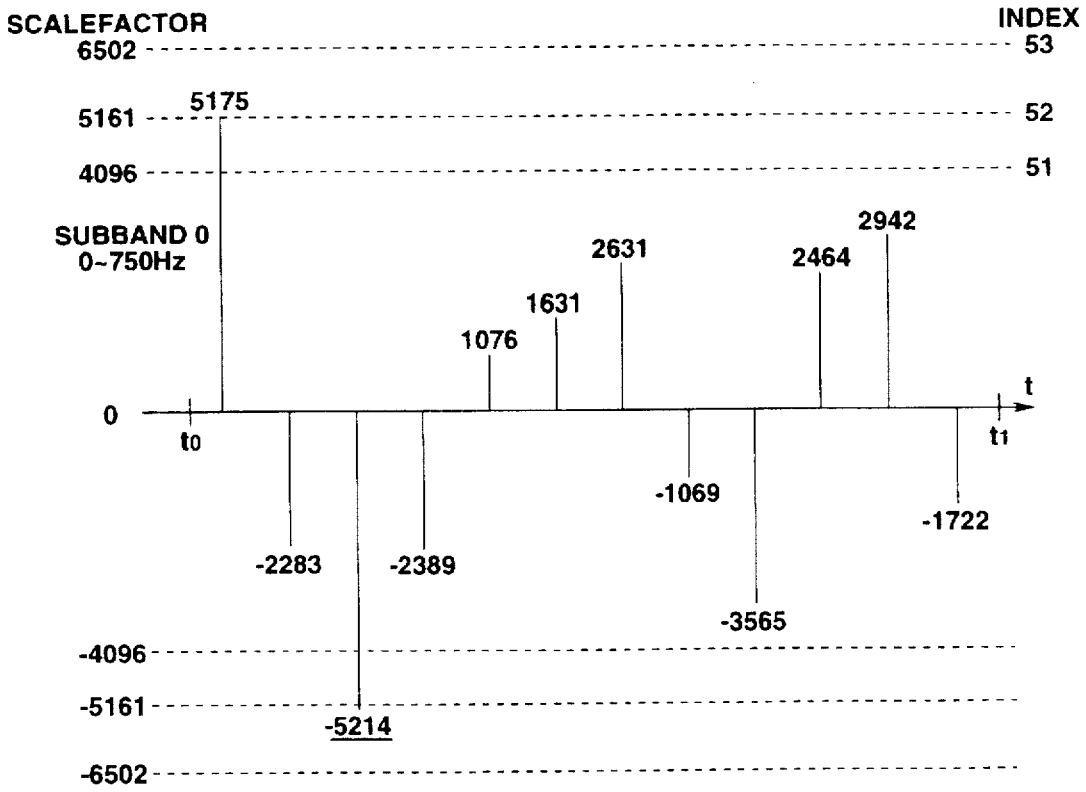
FIG. 4 is a view showing an example of sample values of sub-band signals subjected to band division by the analysis filter bank and scale factor.

For example, assuming that 12 samples in the frame of time $t_0$~$t_1$ of subband signals of subband 0 with respect to the input signal shown in the FIG. 2 mentioned above have respective values as shown in FIG. 4, since the maximum absolute value is "5214" and satisfies the following inequality relationship $$5161 \leqq 5214 < 6502,$$

scale factor SF of the subband 0 in this frame becomes "6502". Also with respect to the remaining respective subbands subband 1~subband 31, scale factors SF can be similarly determined.

Moreover, the bit allocation section 103 determines the numbers of allocation bits with respect to respective subband signals in accordance with the scale factors SF of respective subband signals calculated by the scaling section 102.

The bit allocation processing in the bit allocation section 103 will now be described with reference to the flowchart shown in FIG. 5.

Initially, at step SP301, the number of bits adb which can be utilized for quantization of sub-band signals, the number of bits bspl of sub-band signal, the number of quantization bits b[i] of each subband signal, flag indicating whether or not the number of bits is allocated to each sub-band signal (hereinafter referred to as discrimination flag) used [i], and energy $\sigma^2$ [i] of each sub-band signal are respectively initialized.

In more practical sense, the number of bits adb which can be utilized for quantization of subband signal is set a value represented by adb=cb−(bbal+bscf), i.e., a value obtained by subtracting the number of bits bbal necessary for bit allocation and the number of bits bscf of scale factor from the number of all utilizable bits cb.

Moreover, setting is made such that bspl=0, b [i]=0 and used [i]=0, i.e., the number of bits bspl of subband signal, the number of quantization bits b [i] of each subband signal, and discrimination flag used [i] are respectively equal to "0".

Further, setting is made such that σ[i]=SF[i], i.e., with "σ[i]" being as scale factor SF[i], energy $\sigma^2$ [i] of each subband signal is given by square of scale factor SF [i] of each sub-band signal.

In the case where used [i]=0,i.e., the discrimination flag used [i] is "0", it is indicated that the number of bits is not yet allocated to the corresponding subband. Moreover, in the case where used [i]=1, i.e., the discrimination flag used [i] is "1", it is indicated that the number of bits has been already allocated to the corresponding subband. In addition, in the case where used [i]=2, i.e. , the discrimination flag used [i] is "2", it is indicated that the number of bits cannot be allocated any more to the corresponding subband.

Moreover, the number of bits allocated to each subband is assumed to be 0~15 bits except for 1 bit.

At the subsequent step SP302, whether or not the number of bits can be allocated any more to each subband signal is judged. Namely, whether or not the discrimination flag used [i] ($0 \leqq i \leqq 31$) is "2" is judged. In the case where used [∀i]=2, i.e., bits cannot be allocated to all subband signals, the bit allocation processing in the bit allocation section 103 is completed.

Moreover, at step SP303, in the case where ∃i, such that used [i]≠2, i.e., any subband signal to which the number of bits is allocated exists, a subband signal having the maximum "σ[i]" is taken out from the subband signal to which that number of bits can be allocated. At this time, in the case where a plurality of subbands having the maximum "σ[i]" exist, since sensitivity in the lower frequency band is higher than that in the higher frequency band from a viewpoint of the auditory sense, the subband signal of the lowest frequency band is taken out. Namely, the index max of the subband signal having the maximum "σ[i]" is expressed as follows:

$$max = Min\{i | used[i] \neq 2,\ \sigma[i] \geqq \sigma[\forall j]\}$$

At step SP 304, for the purpose of quantization of the signal of 12 samples of the subband signal having the maximum "σ[i]", the number of bits smplbit to be added is calculated. In the case where any number of bits is not allocated to the subband signal until now, 2 bits per one signal, 24 bits in total are added. In addition, in the case where the number of bits has been already allocated to the subband signal, 1 bit per one signal, 12 bits in total are added. Namely, the number of bits to be added smplbit can be determined by the following operation expressed below:

$$smpl_bit = 24 - used\ [max] \times 12$$

At the subsequent step SP 305, whether or not the number of bits to be added smplbit which has been determined in a manner as described above can be really added is judged. If adb≧bspl+smplbit, i.e., the value obtained by adding the number of bits smplbit which is to be added to the number of bits bspl which has been allocated is less than the number of bits adb which can be utilized for quantization of the subband signal, since the number of bits to be added smpl bit which has been calculated at the above-described step SP304 can be added to the above-mentioned subband signal, the processing operation shifts to the subsequent step SP 306. In contrast, if adb<bspl+smplbit, since the number of bits cannot be allocated any more to the corresponding subband signal, the processing operation shifts to step SP311 to make a setting of used [max]=2, i.e., to set the discrimination flag used [max] to "2" thereafter to return to judgment of bit allocation of the above-described step SP302.

Thus, at step SP306, bspl+=smplbit, i.e., the number of bits to be added smplbit is added to the number of bits bspl which has been allocated for quantization of the subband signal.

At the subsequent step SP307, setting is made such that b [max]+=2−used [max], i.e., in the case where allocation bits are not set until now as the number of quantization bits b [max] of the subband signal (used [max]=0), two bits are added. In contrast, in the case where allocation bits have been already set until now (used [max]=1), 1 bit is added.

Further, at step SP308, setting is made such that σ[max] /=4−used [max]×2 to reduce "σ[max]" of the subband signal. In more practical sense, at the above-described step SP307, in the case where the number of allocation bits is increased by 2 bits, i.e., in the case where the discrimination flag is "0" (used [max]=0), "σ[max]" is divided by "4". In addition, in the case where the number of allocation bits is increased by 1 bit, i.e. in the case where the discrimination flag is "1" (used [max]=1), "σ[max]" is divided by 2.

While, in the initialization processing of the step SP301 of the flowchart shown in the FIG. 5 mentioned above, setting is made such that σ[i]=SF[i], such initialization processing may be conducted as follows.

Namely, quantized value SFid [i] of the dynamic range dr of the subband is used to make a setting described below as indicated by the step SP401 of FIG. 6:

$$\sigma[i]=SFid[i]$$

Since the relationship between the scale factor SF[i] and the quantized value SFid[i] is expressed below from facts as described above, $$SF[i]=r^{SFid[i]/s+k}$$

the processing for dividing the scale factor SF[i] by constant $r^2$ is expressed as follows by using the above-described relationship:

$$\begin{aligned} SF[i]/r^n &= r^{SFid[i]/s+k}/r^n \\ &= r^{SFid[i]/s-n+k} \\ &= r^{(SFid[i]-ns)/s+k} \end{aligned}$$

Namely, this processing can be replaced by the processing to subtract constant ns from the quantized value SFid[i].

Thus, in the processing for reducing "σ[max]" of the above-described step SP 308, the processing for dividing "σ[max]" by "4", i.e., dividing the scale factor SF [max] by "4" is such that when $r^n$ is assumed to be expressed as follows:

$$r^n=4=2^2$$

n is equal to "2" (n=2). Since the constant s is "3" (s=3) as described above, ns is thus expressed as follows:

$$ns=2\times3=6$$

Thus, this processing can be replaced by the processing for subtracting "6" from the scale factor SF [max].

In addition, the processing for dividing "σ[max]" by "2" can be similarly replaced by the processing for subtracting "3".

Accordingly, the processing of the step SP308 shown in the FIG. 5 mentioned above, which is expressed below, $$\sigma[max]/=4-used[max]\times2$$

can be replaced as described below, as indicated by the step SP408 of the FIG. 6 mentioned above $$\sigma[max]-=6-used[max]\times3$$

At the subsequent step SP309, since at least two bits are allocated to the subband signal as described above, setting is made such that used [max]=1, i.e., the discrimination flag used [max] is set to "1".

Further, at step SP310, judgment expressed as b [max]=15 ?, i.e., judgment as to whether or not the number of quantization bits b [max] allocated to the subband signal is 15 bits is made.

In the case where b[max]=15, i.e. the above-mentioned number of quantization bits b[max] was 15 bits at the step SP310, since the number of bits cannot be allocated any more, the processing operation shifts to step SP311 to make a setting of used[max]=2, i.e., to set the discrimination flag used[max] to "2" thereafter to return to the judgment of bit allocation of the above-described step SP302.

In the case where the above-mentioned number of quantization bits b[max] is 14 bits or less, judgment is made such that the number of bits can be still more allocated to the corresponding subband. Thus, the processing operation returns to the judgment of bit allocation of the above-described step SP302 as it is.

At times subsequent thereto, the processing of the step SP302 and the steps subsequent thereto will be repeated until the discrimination flag used [i] becomes equal to "2" with respect to all subband signals.

In a manner as described above, the bit allocation section 103 allocates the numbers of bits to all subband signals by using only scale factors SF[i] (=σ[i]) of respective subband signals.

In more practical sense, assuming that scale factors SF of respective subbands subband 0~subband 31 in the frames of times $t_0$~$t_1$ of the input signal shown in the FIG. 2 mentioned above are determined as indicated by the Table 3, for example, by the acaling section 102, in the case of, e.g., adb=140, result as shown in the Table 4 is obtained by the above-described bit allocation processing at the bit allocation section 103. Namely, 6 bits are allocated to the subband 0, 3 bits are allocated to the subband 1, and 2 bits are allocated to the subband 2. In this case, the numbers of allocation bits of other respective subband 3~subband 31 become equal to zero.

| subband | index | SF(scale factor) |
|---|---|---|
| | Table 3A | |
| 0 | 53 | 6501.995 |
| 1 | 44 | 812.749 |
| 2 | 43 | 645.080 |
| 3 | 31 | 40.317 |
| 4 | 35 | 101.594 |
| 5 | 27 | 16.000 |
| 6 | 27 | 16.000 |
| 7 | 26 | 12.699 |
| 8 | 27 | 16.000 |
| 9 | 24 | 8.000 |
| 10 | 31 | 40.317 |
| 11 | 35 | 101.594 |
| 12 | 27 | 16.000 |
| 13 | 19 | 2.520 |
| 14 | 18 | 2.000 |
| 15 | 17 | 1.587 |
| | Table 3B | |
| 16 | 16 | 1.260 |
| 17 | 21 | 4.000 |
| 18 | 15 | 1.000 |
| 19 | 14 | 0.794 |
| 20 | 17 | 1.578 |
| 21 | 18 | 2.000 |
| 22 | 14 | 0.794 |
| 23 | 13 | 0.630 |
| 24 | 14 | 0.794 |
| 25 | 16 | 1.260 |
| 26 | 14 | 0.794 |
| 27 | 14 | 0.794 |
| 28 | 16 | 1.260 |
| 2g | 16 | 1.260 |
| 30 | 18 | 2.000 |
| 31 | 20 | 3.175 |

| subband | index | SF(scale factor) | allocation |
|---|---|---|---|
| | | Table 4A | |
| 0 | 54 | 6501.995 | 6 |
| 1 | 44 | 812.749 | 3 |
| 2 | 43 | 645.080 | 2 |
| 3 | 31 | 40.317 | 0 |
| 4 | 35 | 101.594 | 0 |
| 5 | 27 | 16.000 | 0 |
| 6 | 27 | 16.000 | 0 |
| 7 | 26 | 12.699 | 0 |
| 8 | 27 | 16.000 | 0 |
| 9 | 24 | 8.000 | 0 |
| 10 | 31 | 40.317 | 0 |
| 11 | 35 | 101.594 | 0 |
| 12 | 27 | 16.000 | 0 |
| 13 | 19 | 2.520 | 0 |
| 14 | 18 | 2.000 | 0 |
| 15 | 17 | 1.587 | 0 |
| | | Table 4B | |
| 16 | 16 | 1.260 | 0 |
| 17 | 21 | 4.000 | 0 |
| 18 | 15 | 1.000 | 0 |
| 19 | 14 | 0.794 | 0 |
| 20 | 17 | 1.578 | 0 |
| 21 | 18 | 2.000 | 0 |
| 22 | 14 | 0.794 | 0 |
| 23 | 13 | 0.630 | 0 |
| 24 | 14 | 0.794 | 0 |
| 25 | 16 | 1.260 | 0 |
| 26 | 14 | 0.794 | 0 |
| 27 | 14 | 0.794 | 0 |
| 28 | 16 | 1.260 | 0 |
| 29 | 16 | 1.260 | 0 |

-continued

| subband | index | SF(scale factor) | allocation |
|---|---|---|---|
| 30 | 18 | 2.000 | 0 |
| 31 | 20 | 3.175 | 0 |

In this example, the bit allocation section 103 is operative so that when only scale factors SF are used to allocate the numbers of bits, in the case where it carries out a processing for dividing the scale factor SF by constant, it conducts divisional operation of real number. In this case, the relationship expressed below is used $$SF=2^{SFid/s+k}$$

to carry out bit allocation in a manner to replace the divisional operation of real number by subtractive operation of integer. Thus, the circuit for bit allocation can become more simplified, and high speed operation can be realized.

Figure 5:
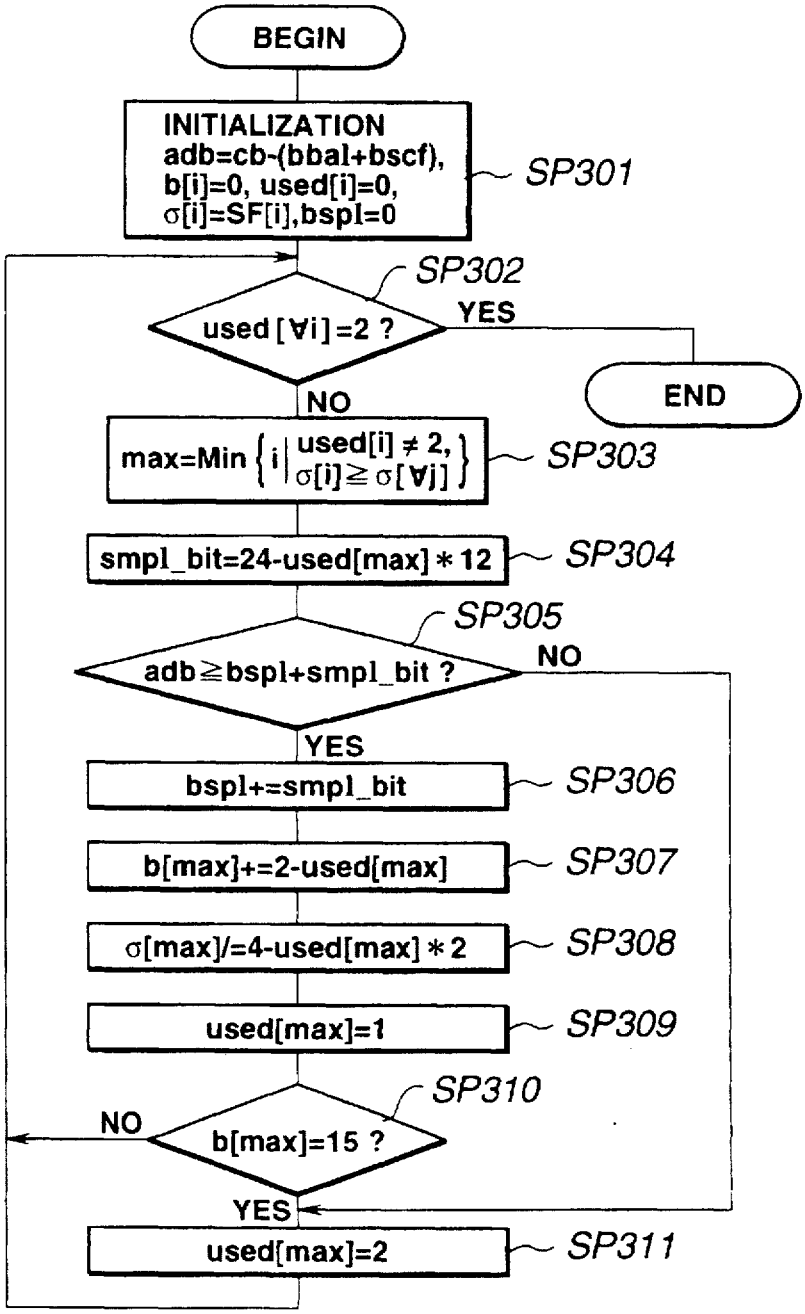
FIG. 5 is a flowchart showing bit allocation processing in bit allocation section of the encoding/decoding apparatus.
Figure 6:
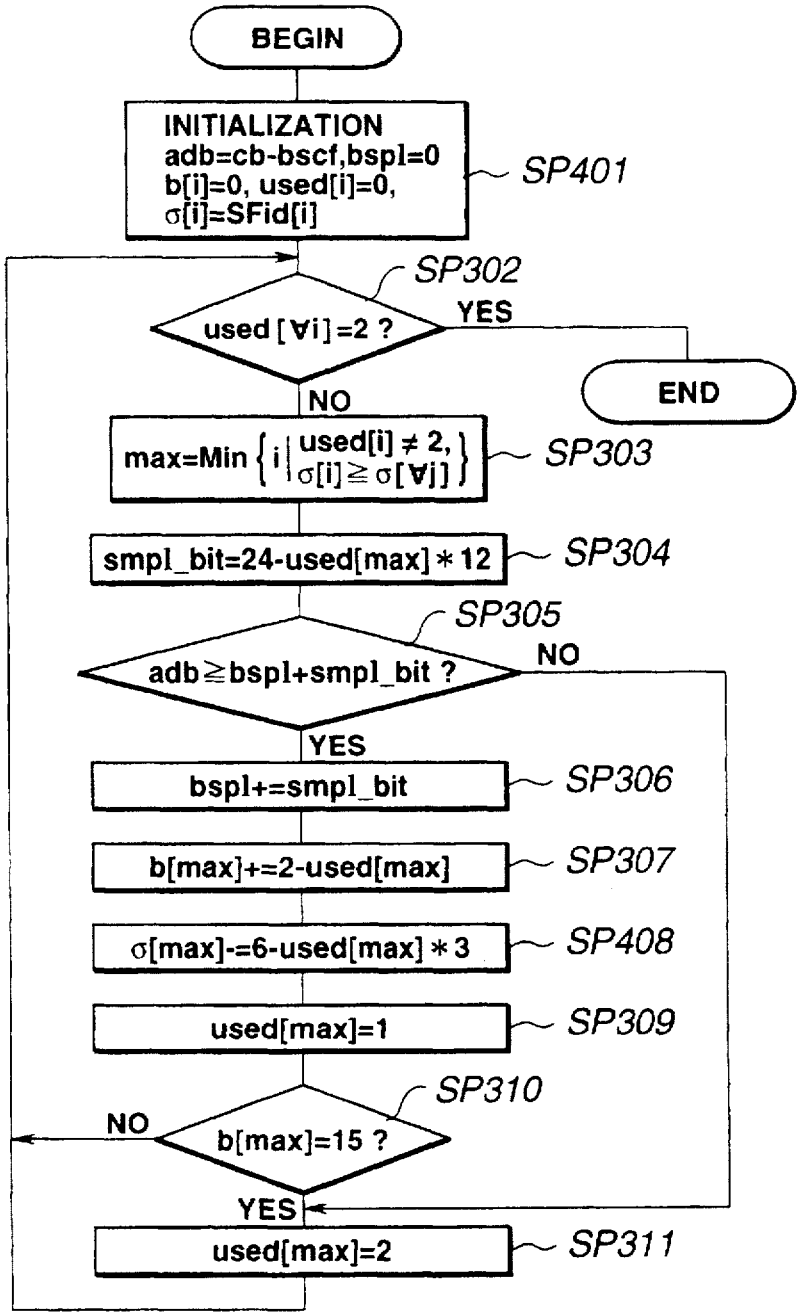
FIG. 6 is a flowchart showing another example of bit allocation processing in the bit allocation section.

It is to be noted that, in the allocation processing for the numbers of bits shown in the FIG. 6 mentioned above, the same step numbers are respectively attached to the same processing as the allocation processing for the numbers of bits shown in the FIG. 5 mentioned above, and their explanation will be omitted.

The quantizing section 104 quantizes respective subband signals in accordance with the above-mentioned formula (1) by the numbers of bits allocated by the bit allocation section 103.

Further, the formatting section 105 composes the quantized subband signals, the scale factors and bit allocation information into a bit stream in accordance with a predetermined format to record it onto storage media 106.

The operation of the encoder 1 constructed in a manner as described above will now be described.

The analysis filter bank 101 divides audio data inputted through input terminal 100 into subband signals of 32 subbands to deliver the subband signals which have undergone band division to the scaling section 102.

The scaling section 102 calculates scale factors SF with respect to respective subband signals from the analysis filter bank 101 by the operation expressed below by using quantized value SFid of the dynamic range of the subband signal, constant r (=2), constant k (=−5) and integer constant s (=3)

$$SF=2^{kSFid/3-5}$$

to deliver the calculated scale factor SF to the bit allocation section 103.

The bit allocation section 103 allocates the number of bits to all subbands by using only the scale factors SF in accordance with the scale factors SF of respective subbands from the scaling section 102. Then, the bit allocation section 103 delivers the determined number of allocation bits and the scale factors SF to the quantizing section 104.

The quantizing section 104 quantizes the subband signals corresponding to the allocated numbers of bits and the scale factors SF from the bit allocation section 103 by the allocated number of bits from the bit allocation section 103 to deliver the subband signals and the scale factors SF which have been quantized to the formatting section 105.

The formatting section 105 composes the quantized subband signals, bit allocation information and the quantized scale factors from the quantizing section 104 into a bit stream in accordance with a predetermined format to record it onto storage media 106.

In a manner as described above, at the encoder 1, quantization of respective subband signals is carried out by the number of allocation bits determined by using only scale factors.

Since the encoding apparatus for audio data of this embodiment carries out bit allocation with respect to respective subbands by using only scale factors SF in a manner as stated above, it is possible to carry out, also in decoding data encoded by the encoding apparatus for audio data, operation of bit allocation similarly to the processing which has been carried out in the above-described encoding. For this reason, in the above-described encoding apparatus for audio data, it becomes unnecessary to output the numbers of allocation bits, and it is unnecessary to set upper limits of each number of allocation bits. Thus, it is possible to allocate bits to quantization of subband signals to such an extent free from requirements as described above. Accordingly, it is possible to allocate sufficient number of bits also to signals of a specific frequency. Thus, improvement in the quantization efficiency can be made.

Moreover, an approach is employed to give scale factor SF by the following formula $$SF=r^{SFid/s+k}$$

, thereby making it possible to replace the processing which divides scale factor SF by constant $r^n$ by the processing which subtracts constant s×n from quantized value SFid. For this reason, in the circuit for bit allocation, it is possible to replace a dividing circuit of real number by a subtracting circuit of integer. Accordingly, the circuit for bit allocation can be simplified and high speed operation can be realized.

It is to be noted that while respective band signals subject to quantization are caused to be subband signals divided into subbands of a plurality of frequency bands in the encoding apparatus for audio data according to the above-described embodiment, those signals may be spectrum signals divided into spectrum groups of a plurality of frequency bands.

The configuration and the operation of the decoder 2 will now be described.

The decoder 2 is composed of a bit stream development section 107 for decomposing the bit stream recorded onto the storage media 106 by the encoder 1 into quantized subband signals, the bit allocation information and (quantized) scale factors, an inverse quantizing section 108 for inverse-quantizing the quantized subband signals decomposed by the bit stream development section 107 so that the scale factors can be preserved, and a synthesis filter bank 109 for synthesizing the subband signals inversely quantized by the inverse quantizing section 108 into an audio signal to output it through an output terminal 110.

The inverse-quantizing section 108 is supplied with quantized value Y[j] (0≦j<12) of subband signal from the bit stream development section 107, the number of quantization bits, and scale factor SF[id]. In this example, the above-mentioned "id" indicates index of scale factor, and the "SF[id]" indicates scale factor having index of "id".

Figure 7:
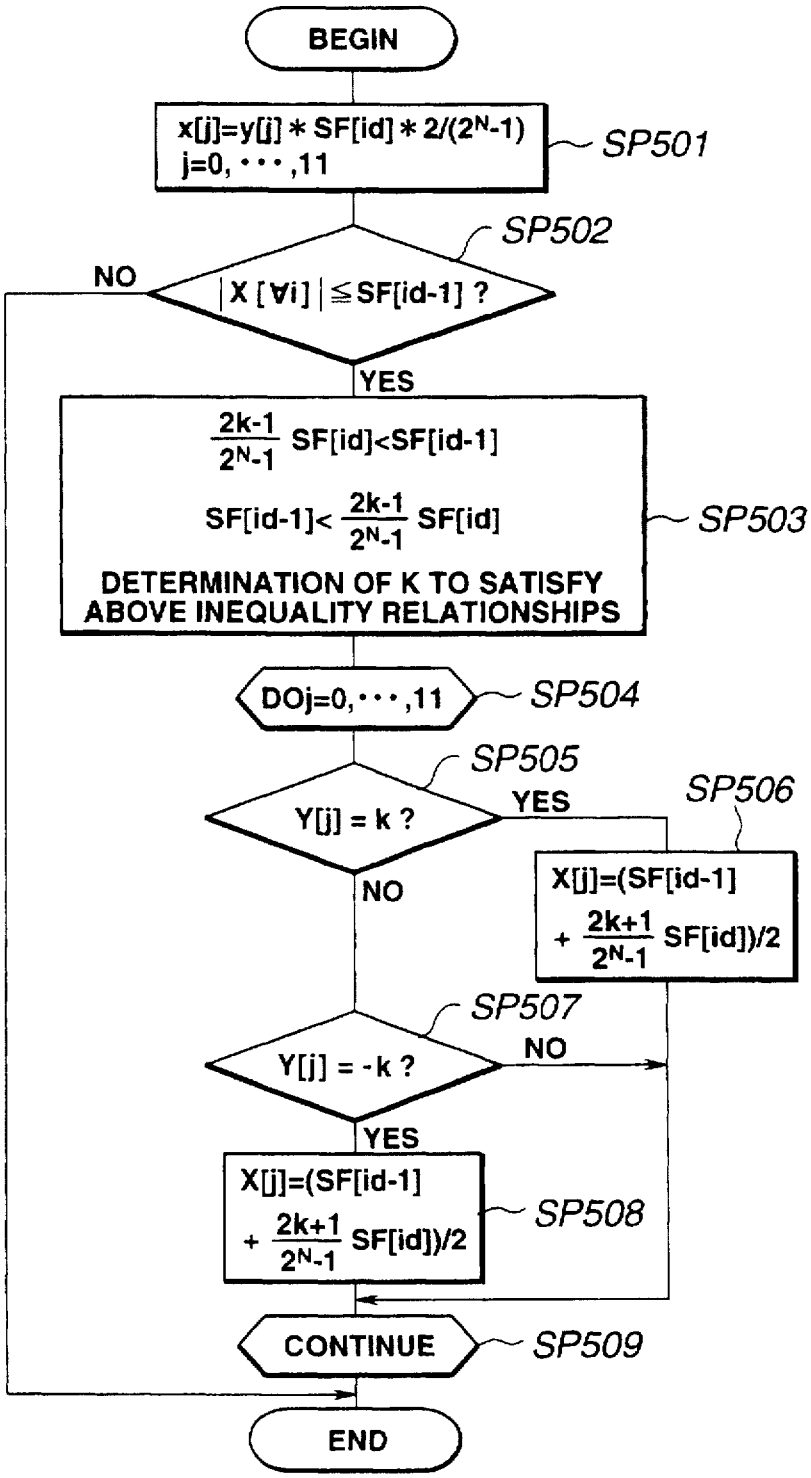
FIG. 7 is a flowchart showing inverse-quantization processing in inverse-quantizing section of the encoding/decoding apparatus.

The inverse-quantizing processing in the inverse-quantizing section 108 will be described below, in more practical sense, with reference to the flowchart shown in FIG. 7.

Initially, at step SP501, in accordance with the above-mentioned formula (2), conventional inverse-quantizing processing is implemented to quantized value Y[i]. Namely, inverse-quantized value X[j] (0≦j<12) of quantized value Y[j] of the subband signal is determined by the operation expressed below:

$$X[j]=Y[j]\times SF[id]\times(2/(2^N-1))$$

At the subsequent step SP502, whether or not the inverse-quantized value X[j] preserves scale factor SF[id] is judged. In more practical sense, in the case where ∃j, such that |X[j]|>SF[id−1], i.e., absolute value |X(j)| of the minimum one of inverse-quantized values X[j] of 12 samples is greater than the scale factor SF[id−1] below by one stage (step), it is judged that the scale factor is preserved. Thus, inverse-quantizing processing at the inverse quantizing section 108 is completed.

Moreover, in the case where |X[∀i]|≦SF [id−1], i.e., with respect to all inverse-quantized values X [j] of 12 samples, their absolute values (|X[j]|) are less than the scale factor SF (id−1), it is judged that no scale factors is preserved. In order to try (carry out) again inverse quantization, the processing operation shifts to step SP503.

AT this step SP503, such a quantized value k (k>0) to bridge over the scale factor SF[id−1] is initially determined.

In more practical sense, $$((2k-1)/(2^N-1))\times SF[id]<SF\ [id-1],\ \text{and}$$

$$SF\ [id-1]<((2k+1)/(2^N-1))\times SF[id]$$

a quantized value k to satisfy the above inequality relationships is determined.

Then, the above-mentioned quantized value k is used to carry out retry processing of inverse quantization which will be explained below with respect to all of quantized values of 12 samples Y[j](0≦j<12).

Initially, at step SP504, whether or not retry processing of inverse quantization has been completed with respect to all quantized values Y[j](0≦j<12) of 12 samples is judged. As a result, in the case where j=12, i.e., retry processing of inverse quantization is completed, the inverse quantizing processing at the inverse quantizing processing section 108 is completed. In contrast, in the case where 0≦j<12, i.e., retry processing of inverse quantization is not completed, the processing operation shifts to step SP505.

At this step SP505, whether or not the quantized value Y[j] is quantized into the quantized value k is judged. Then, in the case where Y[j]=k, i.e., the quantized value Y[j] of the subband signal is quantized into the quantized value k, the processing operation shifts to step SP506. In contrast, in the case where Y[j]≠k, i.e., the quantized value Y[j] of the subband signal is not quantized into the quantized value k, the processing operation shifts to step SP507.

At the step SP506, $$X[j]=\{SF[id-1]+((2k+1)/2^N-1))\times SF[id]\}/2$$

inverse-quantized value X[j] is determined by the operation expressed above. Then, the processing operation shifts to step SP509 to increment the index j to quantized value Y[j] of the next sample thereafter to return to the judgment as to whether or not retry processing of inverse quantization of the above-described step SP504 is completed.

Moreover, at the step SP507, whether or not quantized value Y[j] of the subband signal is quantized into a negative quantized value (−k) is judged.

In the case where Y[j]≠−k, i.e., the quantized value Y[j] of the subband signal is not quantized into the negative quantized value (−k) , the processing operation shifts to the step SP509 to increment the index j to the quantized value Y[j] of the next sample thereafter to return to the judgment as to whether or not retry processing of inverse quantization of the above-described step SP504 is completed. In contrast, in the case where Y[j]=−k, i.e. the quantized value Y[j] of the subband signal is quantized into the negative quantized value (−k), the processing operation shifts to step SP508.

At the step SP508, $$X[j]=-\{SF[id-1]+((2k+1)/(2^n-1))\times SF[id]\}/2$$

inverse-quantized value X[j] is determined by the operation expressed above. The processing operation shifts to step SP509 to increment index j to quantized value Y[j] of the next sample thereafter to return to the judgment as to whether or not retry processing of inverse quantization of the above-described step SP504 is completed As described above, the above-mentioned inverse quantizing section 108 is operative so that in the case where absolute values of inverse quantized values X[j] of 12 samples are all less than the scale factor SF[id−1] below by one stage (one step), it judges that scale factors SF[id] are not preserved to carry out retry processing of inverse quantization to determine, for a second time, inverse quantized values X[j] of 12 samples. Thus, the same scale factors SF[id] as those before quantization can be obtained.

The synthesis filter bank 109 includes a band synthesis section although not shown, and serves to synthesize subband signals which have been caused to undergo inverse quantization into an audio signal by the band synthesis section.

The operation of the decoder 2 constructed in a manner as described above will now be described.

The bit stream development section 107 decomposes bit stream recorded on the storage media 106 of the above-described encoder 1 into quantized subband signals, bit allocation information and (quantized) scale factors to deliver the quantized subband signals, the bit allocation information and the scale factors which have been decomposed to the inverse quantizing section 108.

The inverse quantizing section 108 inverse-quantizes the quantized subband signals from the bit stream development section 107 so that the scale factors from the bit stream development section 107 are preserved. Then, the inverse-quantizing section 108 delivers the inverse-quantized subband signals to the synthesis filter bank 109.

The synthesis filter bank 109 synthesizes the inverse-quantized subband signals from the inverse quantizing section 108 into an audio signal to output the audio signal thus obtained through output terminal 110.

As described above, at the encoder 1, subband signals are quantized by the numbers of allocation bits determined by using only scale factors of respective subbands. At the decoder 2, since the subband signals quantized by the encoder 1 are inverse-quantized so that scale factors of respective subbands are preserved, in the case where encoding and decoding are repeated, the same numbers of allocation bits are determined every time. Accordingly, since the same results can be obtained every time in the quantization and the inverse-quantization, it is possible to carry out dubbing, etc. of audio data without allowing sound quality to be deteriorated even if encoding and decoding operations are repeated.

It is to be noted that, in decomposing, for a second time, audio signals decoded by the decoder 2 into subband signals by the encoder 1 to calculate scale factors, encoding block constituted with 12 subband signals is caused to be the same encoding block as that of the last time.

To speak in more practical sense, e.g., at the inverse quantizing section 108, management of the time required for inverse-quantization (hereinafter referred to as inverse-quantization processing time) is carried out. Then, in carrying out decomposition into 12 subband signals at the analysis filter bank 101, decomposition is carried out in a manner shifted by the inverse quantization processing time, whereby extraction starting times of the encoding block are the same every time Accordingly, the same scale factors can be obtained every time, and the same results can be obtained every time also with respect to the numbers of allocation bits. Thus, it is possible to carry out of copying, etc. of audio data without allowing the sound quality to be deteriorated even if encoding and decoding operations are repeated.

Namely, sample of, e.g., X=−5214 of subband signals of subband 0 in the frame of the time $t_0$~$t_1$ of the input signal shown in the FIG. 2 mentioned above, for example, is quantized into quantized value Y=25 in accordance with the above described formula (1) as follows:

$$\begin{aligned} Y &= rint\{(X/SF)\times((2^N-1)/2)\} \\ &= rint\{(-5214/6502)\times((2^6-1)/2)\} \\ &= 25 \end{aligned}$$

If this is inverse-quantized by the above-described formula (2) in accordance with the conventional technique, the following result is obtained.

$$\begin{aligned} X &= Y\times SF\times(2/(2^N-1)) \\ &= 25\times 6502\times 2/(2^6-1) \\ &= 5160.3 \end{aligned}$$

Its inverse-quantized value X=5160.3 would be a value smaller than the scale factor SF−5160.6 below by one level of the original scale factor SF−6502. Namely since if the inverse quantized value X=5160.3 obtained in this way is quantized for a second time, since the scale factor SF is changed, bit allocation change. Thus, the sound quality would also change.

However, in the encoding/decoding apparatus of this embodiment, in the case where absolute values of inverse quantized values X[j] of 12 samples are less than scale factor SF[id−1] below by one stage (level), it is judged at the inverse quantizing section 108 that scale factors SF[id] are not preserved to retry inverse quantization to obtain inverse-quantized value X[j] having the same scale factor SF[id] as that before quantization. Accordingly, it is possible to preserve scale factors SF[id].

What is claimed is:

1. An encoding method, comprising the steps of:

dividing an input signal into a plurality of signals, each of the signals being in a preselected frequency band;

calculating a corresponding scale factor for each of the signals;

allocating a number of bits to each of the signals as a function of said corresponding scale factor by ascertaining for said each signal whether no bits have been allocated to a respective signal such that 2 bits are allocated to said respective signal, by ascertaining whether some bits have been allocated to said respective signal such that an additional 1 bit is allocated thereto, and by ascertaining whether a predetermined number of bits has been fully allocated to said respective signal such that no additional bits are allocated thereto;

quantizing each of the signals with the corresponding allocated bits; and encoding each of the quantized signals and each of the scale factors.

2. The method according to claim 1, wherein each of the signals is a subband signal.

3. The method according to claim 1, wherein each of the signals is a spectrum signal.

4. The method according to claim 1, wherein said calculating step is defined by $SF=r^{SFid/s+k}$, wherein SFid is a quantized dynamic range of one of the signals, SF is said corresponding scale factor, and r, s and k are predetermined constants.

5. The method according to claim 1, wherein a variable number of bits are allocated to each of the signals.

6. A decoding method for decoding an encoded signal by dividing an input signal into a plurality of signals, each of the signals being in a preselected frequency band, by calculating a corresponding scale factor for each of the signals, by allocating a number of bits to each of the signals as a function of said corresponding scale factor by ascertaining for said each signal whether no bits have been allocated to a respective signal such that 2 bits are allocated to said respective signal, by ascertaining whether some bits have been allocated to said respective signal such that an additional 1 bit is allocated thereto, and by ascertaining whether a predetermined number of bits has been fully allocated to said respective signal such that no additional bits are allocated therto, by quantizing each of the signals with the corresponding allocated bits, and by encoding each of the quantized signals and each of the scale factors, said decoding method comprising the steps of:

determining how many bits had been allocated to each of the signals as a function of the encoded corresponding scale factor;

inverse-quantizing each of the signals with the corresponding allocated bits;

determining whether each of the scale factors is preserved; and inverse-quantizing each of the signals if none of the scale factors is preserved, wherein said encoded signal is so decoded that each of the scale factors is preserved.

7. The method according to claim 6, wherein each of the signals is a subband signal.

8. The method according to claim 6, wherein each of the signals is a spectrum signal.

9. An encoding/decoding method, comprising the steps of:

dividing an input signal into a plurality of signals, each of the signals being in a preselected frequency band;

calculating a corresponding scale factor for each of the signals;

allocating a number of bits to each of the signals as a function of said corresponding scale factor by ascertaining for said each signal whether no bits have been allocated to a respective signal such that 2 bits are allocated to said respective signal, by ascertaining whether some bits have been allocated to said respective signal such that an additional 1 bit is allocated thereto, and by ascertaining whether a predetermined number of bits has been fully allocated to said respective signal such that no additional bits are allocated thereto;

quantizing each of the signals with the corresponding allocated bits;

encoding each of the quantized signals and each of the scale factors;

determining how many bits had been allocated to each of the signals as a function of the encoded corresponding scale factor;

inverse-quantizing each of the signals with the corresponding allocated bits;

determining whether each of the scale factors is preserved; and inverse-quantizing each of the signals if none of the scale factors is preserved, wherein said encoded signal is so decoded that each of the scale factors is preserved.

10. The method according to claim 9, wherein each of the signals is a subband signal.

11. The method according to claim 9, wherein each of the signals is a spectrum signal.

12. The method according to claim 9, wherein said calculating step is defined by $SF=r^{SFid/s+k}$, wherein SFid is a quantized dynamic range of one of the signals, SF is said corresponding scale factor, and r, s and k are predetermined constants.

13. The method according to claim 9, wherein a variable number of bits are allocated to each of the signals.

14. Encoding apparatus, comprising:

band dividing means for dividing an input signal into a plurality of signals, each of the signals being in a preselected frequency band;

scaling means for calculating a corresponding scale factor for each of the signals;

bit allocation means for allocating a number of bits to each of the signals as a function of said corresponding scale factor by ascertaining for said each signal whether no bits have been allocated to a respective signal such that said bit allocation means is operative to allocate 2 bits to said respective signal, by ascertaining whether some bits have been allocated to said respective signal such that said bit allocation means is operative to allocate an additional 1 bit thereto, and by ascertaining whether a predetermined number of bits has been fully allocated to said respective signal such that said bit allocation means is operative to allocate no additional bits thereto;

quantizing means for quantizing each of the signals with the corresponding allocated bits; and formatting means for encoding each of the quantized signals and each of the scale factors, and for outputting thereof.

15. Apparatus according to claim 14, wherein each of the signals is a subband signal.

16. Apparatus according to claim 14, wherein each of the signals is a spectrum signal.

17. Apparatus according to claim 14, wherein said corresponding scale factor is defined by $r^{SFid/s+k}$, wherein SFid is a quantized dynamic range of one of the signals, and r, s and k are predetermined constants.

18. Apparatus according to claim 14, wherein a variable number of bits are allocated to each of the signals.

19. Decoding apparatus for decoding an encoded signal, including band dividing means by dividing an input signal into a plurality of signals, each of the signals being in a preselected frequency band, scaling means for calculating a corresponding scale factor for each of the signals, bit allocation means for allocating a number of bits to each of the signals as a function of said corresponding scale factor by ascertaining for said each signal whether no bits have been allocated to a respective signal such that said bit allocation means is operative to allocate 2 bits to said respective signal, by ascertaining whether some bits have been allocated to said respective signal such that said bit allocation means is operative to allocate an additional 1 bit thereto, and by ascertaining whether a predetermined number of bits has been fully allocated to said respective signal such that said bit allocation means is operative to allocate no additional bits thereto, quantizing means for quantizing each of the signals with the corresponding allocated bits, and formatting means for encoding each of the quantized signals and each of the scale factors, and for outputting thereof, said decoding apparatus comprising:

means for determining how many bits had been allocated to each of the signals as a function of the encoded corresponding scale factor;

means for inverse-quantizing each of the signals with the corresponding allocated bits;

means for determining whether each of the scale factors is preserved; and means for inverse-quantizing each of the signals if none of the scale factors is preserved, wherein said encoded signal is so decoded that each of the scale factors is preserved.

20. Encoding/decoding apparatus, comprising:

band dividing means for dividing an input signal into a plurality of signals, each of the signals being in a preselected frequency band;

scaling means for calculating a corresponding scale factor for each of the signals;

bit allocation means for allocating a number of bits to each of the signals as a function of said corresponding scale factor by ascertaining for said each signal whether no bits have been allocated to a respective signal such that said bit allocation means is operative to allocate 2 bits to said respective signal, by ascertaining whether some bits have been allocated to said respective signal such that said bit allocation means is operative to allocate an additional 1 bit thereto, and by ascertaining whether a predetermined number of bits has been fully allocated to said respective signal such that said bit allocation means is operative to allocate no additional bits thereto;

quantizing means for quantizing each of the signals with the corresponding allocated bits;

formatting means for encoding each of the quantized signals and each of the scale factors, and for outputting thereof;

means for determining how many bits had been allocated to each of the signals as a function of the encoded corresponding scale factor;

means for inverse-quantizing each of the signals with the corresponding allocated bits;

means for determining whether each of the scale factors is preserved; and means for inverse-quantizing each of the signals if none of the scale factors is preserved, wherein said encoded signal is so decoded that each of the scale factors is preserved.

21. Apparatus according to claim 20, wherein each of the signals is a subband signal.

22. Apparatus according to claim 20, wherein each of the signals is a spectrum signal.

23. Apparatus according to claim 20, wherein said corresponding scale factor is defined by $r^{SFid/s+k}$, wherein SFid is a quantized dynamic range of one of the signals, and r, s and k are predetermined constants.

24. Apparatus according to claim 20, wherein a variable number of bits are allocated to each of the signals.

* * * * *